US009334599B2

(12) United States Patent
Gelber et al.

(10) Patent No.: US 9,334,599 B2
(45) Date of Patent: May 10, 2016

(54) SYSTEM AND METHOD FOR SAFELY POWERING AN APPLIANCE USER INTERFACE WITHOUT EXTERNAL POWER

(71) Applicant: General Electric Company, Schenectady, NY (US)

(72) Inventors: Scott Michael Gelber, Athens, AL (US); Steven Michael Recio, Louisville, KY (US); Richard D. Suel, II, Louisville, KY (US); Jonathan Blair Talmadge, Louisville, KY (US); Heather Rae Posthauer, Louisville, KY (US); Ryan James Scheckelhoff, Louisville, KY (US); Abhijeet A. Bhandwale, Louisville, KY (US); Byron Lee Boylston, Louisville, KY (US)

(73) Assignee: General Electric Company, Schenectady, NY (US)

( * ) Notice: Subject to any disclaimer, the term of this patent is extended or adjusted under 35 U.S.C. 154(b) by 608 days.

(21) Appl. No.: 13/743,606

(22) Filed: Jan. 17, 2013

(65) Prior Publication Data

US 2014/0196508 A1 Jul. 17, 2014

(51) Int. Cl.

| | |
|---|---|
| ***H02H 3/00*** | (2006.01) |
| ***D06F 37/30*** | (2006.01) |
| ***D06F 33/02*** | (2006.01) |
| *D06F 37/42* | (2006.01) |

(52) U.S. Cl.

CPC ..... *D06F 37/30* (2013.01); *D06F 33/02* (2013.01); *D06F 37/42* (2013.01); *D06F 2202/065* (2013.01); *D06F 2202/12* (2013.01); *D06F 2224/00* (2013.01)

(58) Field of Classification Search

CPC ..... H02H 3/00
USPC ..... 318/370, 34, 558
See application file for complete search history.

(56) References Cited

U.S. PATENT DOCUMENTS

| | | | | |
|---|---|---|---|---|
| RE37,360 | E * | 9/2001 | Duncan | D06F 37/306 318/281 |
| 6,445,879 | B1 | 9/2002 | Youn et al. | |
| 7,904,984 | B2 * | 3/2011 | Koo et al. | 8/158 |
| 7,966,099 | B2 * | 6/2011 | Fima | E03B 1/00 239/128 |
| 9,103,061 | B2 * | 8/2015 | Jeffery | D06F 33/02 |

FOREIGN PATENT DOCUMENTS

| | | |
|---|---|---|
| WO | WO 2011/073061 | 6/2011 |

* cited by examiner

*Primary Examiner* — David S Luo
(74) *Attorney, Agent, or Firm* — Dority & Manning, P.A.

(57) ABSTRACT

Systems and methods for safely powering an appliance user interface without external power are provided. One exemplary method includes receiving power generated by rotation of a rotor. The method further includes monitoring for the presence of a safety condition and disabling passive braking of the rotor when the safety condition is present such that the user interface of an appliance is powered. An exemplary washing machine can include a basket and a motor which includes a rotor, the motor being configured to rotate the basket by rotating the rotor. The washing machine can further include a user interface and a motor control circuit configured to drive the motor. The motor control circuit can be further configured to receive power generated by rotation of the rotor, monitor for the presence of a safety condition, and disable passive braking of the rotor when the safety condition is present.

19 Claims, 3 Drawing Sheets

SYSTEM AND METHOD FOR SAFELY POWERING AN APPLIANCE USER INTERFACE WITHOUT EXTERNAL POWER

FIELD OF THE INVENTION

The present disclosure relates generally to safely powering an appliance. More particularly, the present disclosure relates to safely powering an appliance user interface without external power, such as AC line power or a battery.

BACKGROUND OF THE INVENTION

In certain circumstances it can be desirable to power a user interface of an appliance without supplying an external source of power, such as AC line power or a battery. For instance, marketing or sales individuals can desire to demonstrate to potential customers the features or functionality offered by the appliance user interface. However, for a number of reasons it can be impossible or undesirable to have the appliance attached to an external power supply. For example, the sales floor of an appliance retailer can house a large number of appliances. Providing an external power supply for each of such appliances can prove inefficient, undesirable, or otherwise impossible. Thus, it is desirable to provide a system and method for powering an appliance user interface without external power.

However, even in the instance in which the appliance can be powered without external power, such features must still be incorporated into the appliance in a manner which ensures user safety. For example, moving components of an appliance can pose certain risks or dangers to a user who seeks to power the appliance to demonstrate the user interface. Therefore, it is desirable to provide a system and method for safely powering an appliance user interface without external power.

BRIEF DESCRIPTION OF THE INVENTION

Aspects and advantages of the invention will be set forth in part in the following description, or can be obvious from the description, or can be learned through practice of the invention.

One exemplary aspect of the present disclosure is directed to a method for safely powering a user interface of an appliance. The method includes receiving power generated by rotation of a rotor. The rotor is an element of a motor of the appliance. The method further includes monitoring for the presence of a safety condition and disabling passive braking of the rotor when the safety condition is present such that the user interface of the appliance is powered.

Another exemplary aspect is directed to a washing machine. The washing machine can include a basket and a motor which includes a rotor. The motor is configured to rotate the basket by rotating the rotor. The washing machine can further include a user interface and a motor control circuit configured to drive the motor. The motor control circuit can be further configured to receive power generated by rotation of the rotor, monitor for the presence of a safety condition, and disable passive braking of the rotor when the safety condition is present.

Another exemplary aspect is directed to a motor control circuit configured to drive a motor having a rotor. The motor control circuit can include a DC bus configured to be charged when the rotor is rotated. The motor control circuit can also include an AC line sensor configured to sense the presence of externally supplied AC power. The motor control circuit can further include a gate driver. The gate driver is configured to apply passive braking to the rotor upon initialization. The motor control circuit can also include a user interface. The user interface receives power from the DC bus after passive braking of the rotor is disabled.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
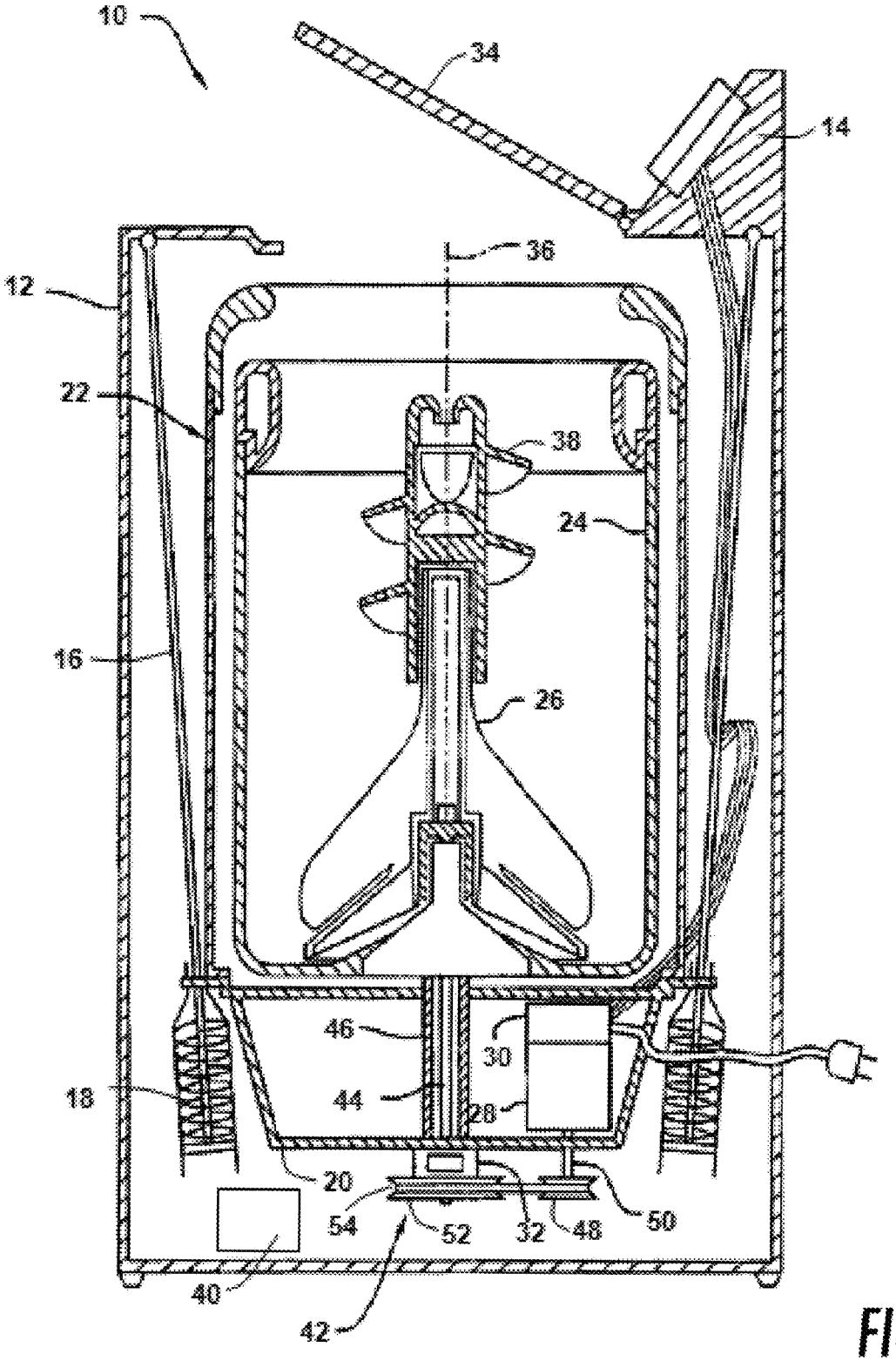
FIG. 1 is a side cut-away view of a washing machine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to systems and methods for safely powering an appliance user interface without external power. In particular, a washing machine motor can be configured to generate power when a basket of the washing machine is rotated by a user. The generated power can be used to power components of the washing machine, including a user interface.

To enhance safety, a motor control circuit of the appliance can apply passive braking to the motor upon initialization by default. The motor control circuit can monitor for the presence of a safety condition and disable passive braking when the safety condition is present. Applying passive braking in such fashion enhances user safety by defaulting into an intrinsically safe state and only permitting free rotation of the basket after the safety condition has been satisfied.

According to an exemplary method, power generated by rotation of a rotor can be received. The rotor can be an element of a motor of the appliance. Further, the presence of a safety condition can be monitored. The safety condition can require that one or more operating conditions be satisfied. For example, the safety condition can require an absence of externally supplied power. As another example, the safety condition can require a rotor rotation speed less than a threshold speed. As yet another example, the safety condition can require that a door of the appliance be open.

Passive braking of the rotor can be enabled while monitoring for the presence of the safety condition. In particular, a motor control circuit can be configured to apply passive braking to the rotor upon initialization. For example, passive braking of the motor can be applied by a gate driver configured to drive the motor. Such passive braking can continue until the gate driver is disabled.

For example, passive braking can be applied by a default configuration of a plurality of switching elements in an inverter bridge circuit. Further, a plurality of resistors can ensure that the plurality of switching elements are configured to apply passive braking upon initialization (i.e. before a controller or processor boots and provides signals to actively control the plurality of switching elements). Such passive braking enhances user safety while monitoring for the presence of the safety condition.

When the safety condition is present, passive braking of the rotor can be disabled. Alternatively, multiple safety conditions can be monitored simultaneously or sequentially and passive braking of the rotor can be disabled only when all safety conditions are present. In one implementation, a motor control circuit can include a processor configured to disable passive braking of the rotor by disabling a gate driver. When the safety condition is no longer present, passive braking can be re-enabled.

Disabling passive braking of the rotor can allow the rotor to spin freely, generating additional power that powers the appliance user interface. Once powered, the user interface of the appliance can operate in a demonstration mode. Such demonstration mode can turn on any associated displays and indicators, can emit a noise, or otherwise simulate a fully functioning appliance. Operating the user interface in such demonstration mode allows a prospective customer to envision a functioning appliance.

FIG. 1 depicts an exemplary washing machine 10 that can be configured in accordance with aspects of the present disclosure. As mentioned, it should be appreciated that the particular type or style of washing machine 10 is not a limiting factor of the invention, and that the machine 10 depicted in FIG. 1 and described herein is for illustrative purposes only. For example, aspects of the present disclosure are just as applicable to front-loading washing machines.

The washing machine 10 includes a cabinet 12 that supports internal components of the washing machine 10, and a backsplash 14 on which are mounted various controls, a display, and so forth. Supported by the cabinet 12 is a suspension system that includes rods 16, springs 18, and a platform 20. The suspension system, which can be in accordance with system described in U.S. Pat. No. 5,520,029 entitled "Coil Spring and Snubber Suspension System for a Washer," provides the advantage of low transmissibility of out-of-balance forces to the cabinet 12, which improves the stability of the washing machine 10 and reduces system noise.

Supported on the platform 20 are a tub 22, basket 24, agitator 26, motor 28, motor control system 30, and mode shifter 32. The basket 24 holds articles such as clothes to be washed, and is accessed by a lid 34. The agitator 26 agitates the clothes in the basket 24 with a plurality of vanes as the agitator 26 oscillates about the drive axis 36. The washing machine 10 can also include an auger 38 mounted at the top of the agitator 26. The auger 38 further enhances the movement of the clothes within the basket 24. The basket 24 and agitator 26 are coaxially located within the tub 22, which retains the wash liquid (e.g., detergent and water) during the wash cycle. A pump 40 is provided to remove the wash liquid from the tub 22 when the wash cycle or rinse cycle is completed.

To power the washing machine 10, a motor 28 is coupled to the basket 24 and agitator 26 through a coupler 42, a mode shifter 32, an agitator drive shaft 44, and a basket drive shaft 46. In the embodiment of FIG. 1, the coupler 42 includes a motor pulley 48 connected to a motor shaft 50, a drive pulley 52 connected to the agitator drive shaft 44, and a belt 54 connecting the motor pulley 48 and the drive pulley 52. The motor 28 is a synchronous electric motor, and is desirably a variable speed motor.

As is understood in the art, a synchronous motor is generally defined as a motor distinguished by a rotor spinning at zero slip with the rotating magnetic field that drives it. Thus, such motors operate synchronously with the frequency generated by the inverter. A common example of a synchronous motor is a single or multiple-phase AC synchronous motor with a permanent magnet rotor. A brushless DC motor (also referred to as an electrically commutated (EC) motor) is another type of synchronous motor that uses switched DC fed to the stator and a permanent magnet rotor. Commutation of the windings in an EC motor is achieved by a solid-state circuit controlled by suitable means for sensing rotor position. A permanent magnet AC synchronous motor and an EC motor operate in similar manners. A permanent magnet motor can have an external rotor configuration.

A variable speed motor 28 is advantageous, because its rotational velocity and torque can be easily controlled, as compared, for example, with a traditional single phase AC induction motor. For example, a variable speed motor can be programmed to measure the torque induced in proportion to the clothes load. The resulting signal can be transmitted to a motor control system 30 during the fill operation to fill the tub 22 with just enough water to efficiently wash the clothes, thereby minimizing the water and energy usage. Examples of variable speed motors include brushless DC motors (e.g., EC motors and switched reluctance motors), and permanent magnet synchronous motors. Because the torque, speed and rotational direction of the variable speed motor 28 are easily controlled, the washing machine 10 can operate without a transmission to change the direction of motion during the agitation mode. The motion of the agitator 26 and basket 24 in the various modes of the wash cycle is achieved with the motor control system 30.

The motor control system 30 includes any manner of hardware/software configuration for controlling the various operating functions of the machine 10. For example, the motor control system 30 can include a processor or controller that is programmed to control the currents and voltages input to the motor for effecting motor reversal and thus the oscillatory motion of the agitator 26 in the agitate mode, or to increase the frequency of power supplied to the stator coils in spin mode to increase the rotational velocity of the basket 24 and agitator 26. The motor control system 30 can also be programmed to carry out the various phases of the passive braking process, as described in greater detail below.

Figure 2:
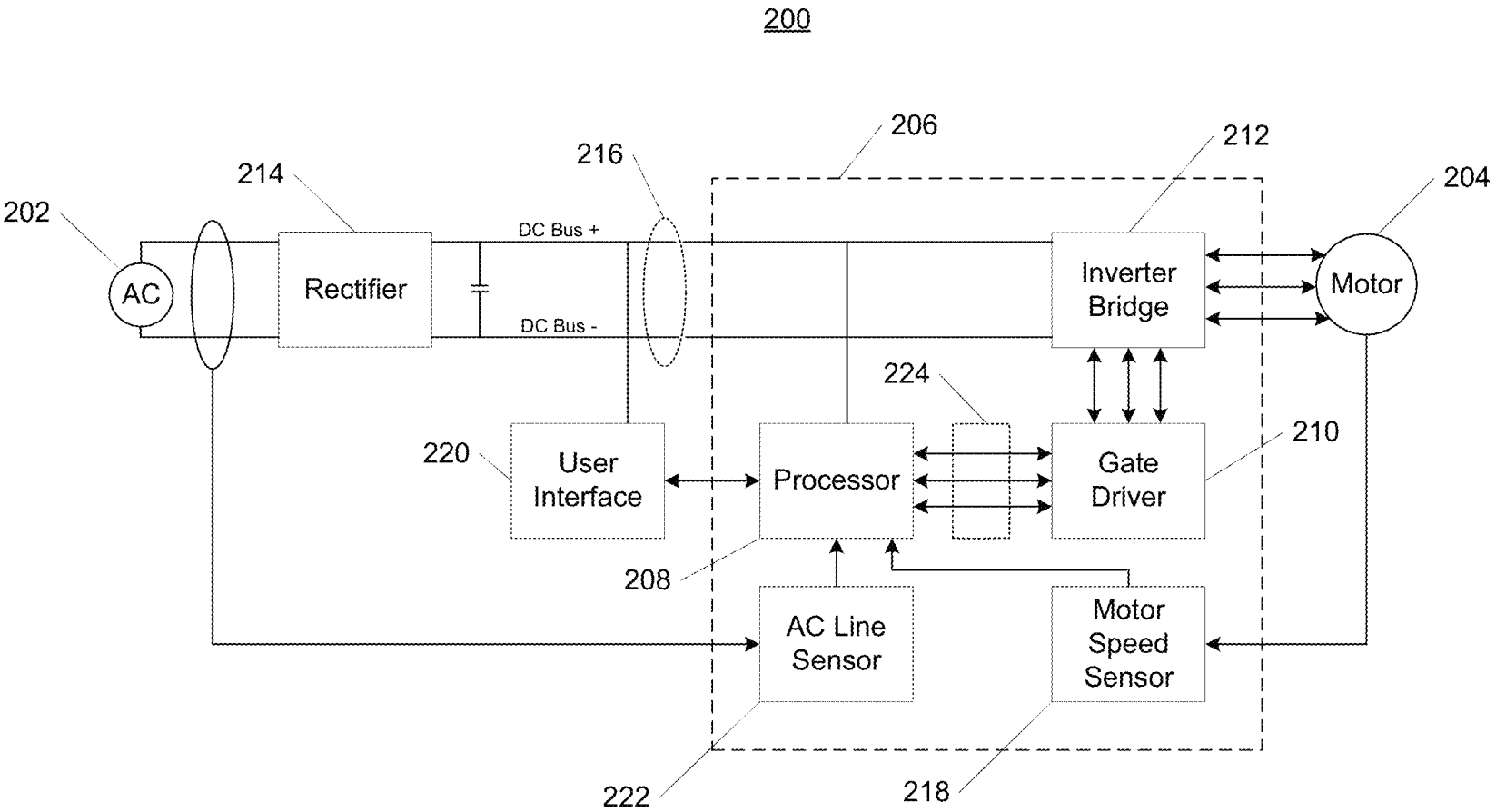
FIG. 2 depicts a block diagram view of an exemplary appliance control system according to an exemplary embodiment of the present disclosure.

FIG. 2 depicts a block diagram view of an exemplary appliance control system 200 according to an exemplary embodiment of the present disclosure. Appliance control system 200 can be implemented to include a suitable motor control system, such as motor control system 30 of FIG. 1. Appliance control system 200 can include an AC power connector 202, a motor 204, and a motor control circuit 206. AC power connector 202 can receive AC line power generated by a utility that exhibits defined frequency and voltage characteristics. AC power from AC power connector 202 can be converted into DC power by rectifier 214. Such DC power can be carried on a DC bus 216. One of skill in the art, in light of the disclosures contained herein, will understand that other components may be included within appliance control system 200 without departing from the scope of the present disclosure. In particular, appliance control system 200 can further include a DC power connector that receives DC power provided by a battery or other external source.

Motor control circuit 206 can operate and apply passive braking to motor 204. According to one aspect of the disclosure, motor 204 can generate power and charge DC bus 216 when the rotor is rotated and motor operating energy is not being applied. For example, motor 204 can be a permanent magnet synchronous motor or a brushless DC motor. As another example, motor 204 can be motor 28 of washing machine 10 of FIG. 1.

Motor control circuit 206 can include a processor 208, a gate driver 210, and an inverter bridge 212. Processor 208 can be one processor or can be a plurality of processors which are operably connected. Inverter bridge 212 can include a plurality of switching elements which convert DC power carried on DC bus 216 to AC power which drives motor 204.

In particular, inverter bridge 212 can include three pairs of switching elements, each pair having a high-side switching element and a low-side switching element. The three pairs of switching elements can be configured in a traditional three-phase inverter bridge configuration. Gate driver 210 can drive the switching of the plurality of switching elements. Likewise, processor 208 can control or otherwise provide signals to gate driver 210.

Figure 3:
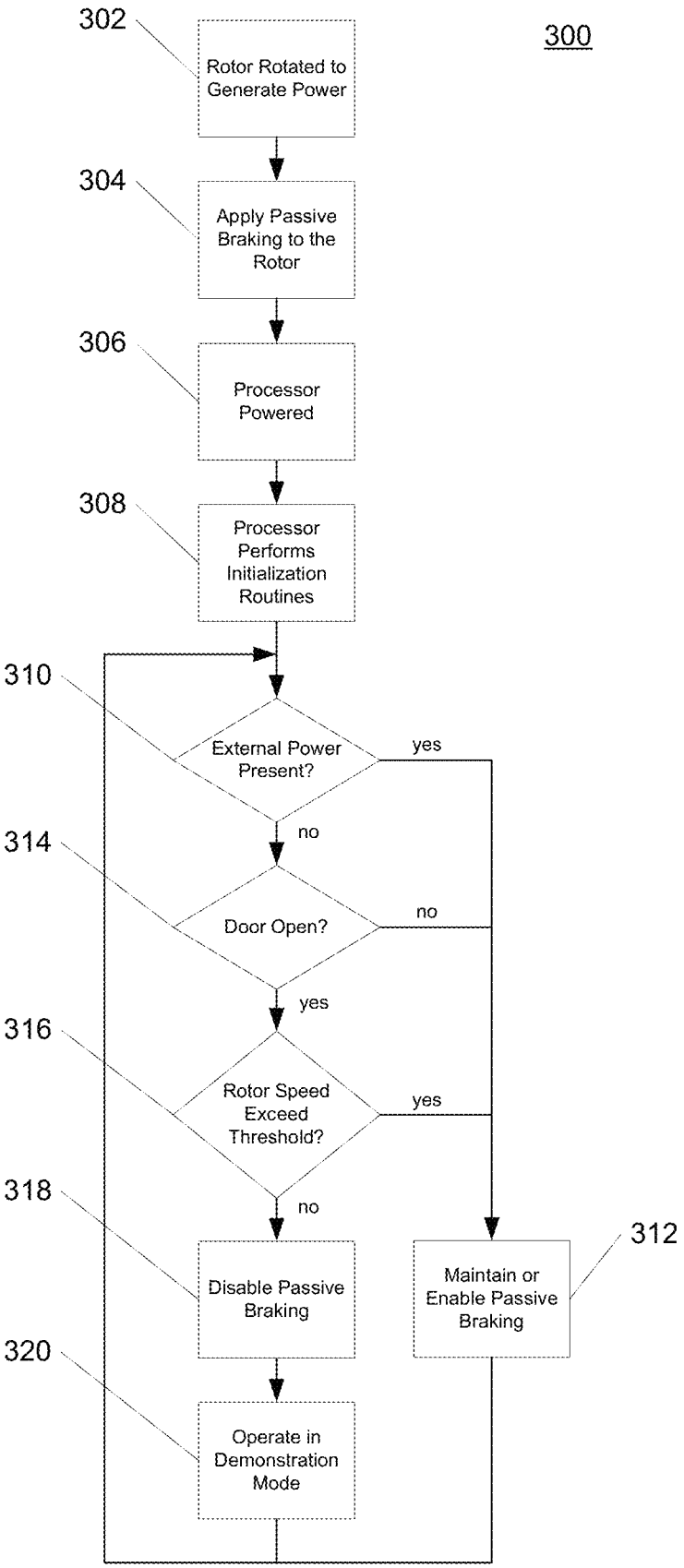
FIG. 3 depicts a flow chart of an exemplary method of operating an appliance according to an exemplary embodiment of the present disclosure.

FIG. 3 depicts a flow chart of an exemplary method (300) of operating an appliance according to an exemplary embodiment of the present disclosure. While exemplary method (300) will be discussed with reference to FIG. 2, exemplary method (300) can be implemented using any suitable appliance or appliance control system, such as washing machine 10 or motor control system 30 of FIG. 1. In addition, although FIG. 3 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

At (302) a rotor of a motor is rotated to generate power. For example, the rotor of motor 204 can be rotated to generate power and charge DC bus 216. In particular, motor 204 can be a permanent magnet synchronous motor or brushless DC motor that is rotatably connected to a basket of a washing machine. A user can rotate the washing machine basket and consequently rotate the rotor of motor 204. When the basket is rotated in such fashion motor 204 can generate power and charge DC bus 216.

Returning to FIG. 3, at (304) passive braking is applied to the rotor. For example, motor control circuit 206 can initialize or otherwise power up due to the power generated by the rotation of the rotor of motor 204. Motor control circuit 206 can be configured to apply passive braking to the rotor of motor 204 upon initialization.

In one implementation, motor control circuit 206 can power up by default with gate driver 210 enabled and selected switching elements of inverter bridge 212 activated. For example, motor control circuit 206 can include a plurality of conditioning elements 224 which condition one or more inputs of gate driver 210 to ensure that that the selected switching elements of inverter bridge 212 are activated by default upon initialization (i.e. before processor 208 boots and provides signals to actively control the plurality of switching elements), such that passive braking is applied.

Conditioning elements 224 can be a plurality of pull-up resistors, pull-down resistors, or other suitable conditioning elements. In one implementation, conditioning elements 224 can be a plurality of pull-down resistors populated between a low side logic input of gate driver 210 and a ground. Such pull-down resistors can ensure that gate driver 210 activates the low-side switching elements of inverter bridge 212 by default. Such configuration can apply passive braking to the rotor upon initialization.

One of skill in the art, in light of the disclosures contained herein, will understand that many various orientations or configurations of various hardware components can be used to apply passive braking to a rotor. The configurations discussed herein are exemplary in nature and do not limit the scope of the disclosure. Any configuration of components which provides passive braking to the rotor upon initialization can be used to satisfy exemplary method (300). In addition, while conditioning elements 224 are depicted in FIG. 2 as stand-alone elements of motor control circuit 206, one of skill in the art, in light of the disclosures contained herein, will recognize that conditioning elements 224 can be conceptually included within gate driver 210 or processor 208.

Returning to FIG. 3, at (306) a processor is powered and at (308) the processor performs initialization routines. The processor can be powered by the power generated at step (302). As an example, DC bus 216 can be charged by the rotation of the rotor of motor 204 and subsequently provide power to processor 208. Initialization routines performed by the processor can include checking or altering the status of random access memory, read-only memory, registers, clocks, hardware components, or any other suitable routine.

At (310) the appliance monitors for the presence of external power. For example, the appliance can include a DC power sensor that monitors for the presence of externally supplied DC power such as battery power and provides measurements or other suitable data to a processor. As another example, motor control circuit 206 can include an AC line sensor 222. AC line sensor 222 can monitor the presence and characteristics of AC power received by AC power connector 202 and provide measurements or other suitable data to processor 208. AC line sensor 222 can include a timer or other suitable components for detecting the presence of AC power.

If it is determined at (310) that external power is present, then passive braking is maintained or otherwise enabled at (312). Enabling passive braking when external power is present increases the safety of the appliance by reducing the probability that a user will encounter fully powered, moving components.

If it is determined at (310) that external power is not present, then the appliance checks whether a door of the appliance is open at (314). If a door to the appliance is not open then passive braking is maintained or otherwise enabled at (312).

If it is determined at (314) that a door to the appliance is open, then at (316) a rotation speed associated with the rotor is compared to a given threshold speed. For example, motor control circuit 206 can further include a motor speed sensor 218. Motor speed sensor 218 can determine a rotation speed associated with the rotor of motor 204 and provide such rotor rotation speed data to processor 208. Any form of sensor which detects a rotor rotation speed can be used to satisfy the present disclosure, including, for example, a magnetometer or other suitable sensor.

If it is determined at (316) that the rotor rotation speed exceeds a given threshold, then passive braking is maintained or otherwise enabled at (312). Enabling passive braking in such fashion ensures, for example, that a basket of a washing machine does rotate at a dangerous speed.

If it is determined at (316) that rotor rotation speed does not exceed a given threshold, then at (318) passive braking is disabled. Motor control circuit 206 can be configured to disable passive braking of the rotor. For example, processor 208 can disable gate driver 210 to disable passive braking Disabling passive braking of the rotor can allow the rotor to spin freely, generating additional power and charging DC bus 216.

Returning to FIG. 3, after passive braking is disabled at (318), then the appliance can be operated in a demonstration mode at (320). For example, once charged, DC bus 216 can provide power to a user interface 220 and user interface 220 can be operated in a demonstration mode. Such demonstration mode can turn on any associated displays and indicators, can emit a noise, or otherwise simulate a fully functioning appliance. Operating user interface 220 in such demonstration mode allows a prospective customer to envision a functioning appliance.

One of skill in the art, in light of the disclosures contained herein, will understand that selected steps of exemplary method (300) can be performed in an iterative fashion. For instance, steps (310) through (320) can be performed continuously, such that the appliance is constantly monitoring the presence of various safety conditions and enables passive braking at (312) when any of such safety conditions cease to be present. In addition, many various safety conditions can be monitored in addition to those presented within FIG. 3. Such safety conditions can be monitored sequentially or simultaneously.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine comprising:

a basket;

a motor which includes a rotor, the motor being configured to rotate the basket by rotating the rotor;

a user interface; and a motor control circuit configured to drive the motor;

wherein the motor control circuit is further configured to receive power generated by rotation of the rotor, monitor for the presence of a safety condition, and disable passive braking of the rotor when the safety condition is present; and wherein the motor control circuit is configured to apply passive braking to the rotor upon initialization.

2. The washing machine of claim 1, wherein the motor control circuit comprises a gate driver configured to drive the motor and a processor configured to control the gate driver, the processor being configured to disable passive braking of the rotor by disabling the gate driver.

3. The washing machine of claim 2, wherein the gate driver drives the motor by switching a plurality of switching elements, the plurality of switching elements being configured to apply passive braking to the rotor upon initialization.

4. The washing machine of claim 3, further comprising a plurality of resistors configured to ensure that passive braking is applied to the rotor upon initialization.

5. The washing machine of claim 1, wherein the motor control circuit is further configured to apply passive braking to the rotor when the safety condition is no longer present.

6. The washing machine of claim 5, wherein the safety condition requires a rotor rotation speed less than a threshold speed.

7. The washing machine of claim 5, wherein the washing machine further comprises a connection for receiving externally supplied power, the safety condition requiring the absence of externally supplied power.

8. The washing machine of claim 1, wherein the user interface operates in a demonstration mode when the safety condition is present.

9. The washing machine of claim 1, further comprising:

a door;

wherein the safety condition requires the door to be open.

10. The washing machine of claim 1, wherein the motor control circuit comprises:

a gate driver that drives the motor; and one or more conditioning elements which condition one or more inputs of the gate driver to ensure that the gate driver applies passive braking to the motor upon initialization.

11. The washing machine of claim 10, wherein the one or more conditioning elements comprise a plurality of pull-up or pull-down resistors.

12. The washing machine of claim 10, wherein the one or more conditioning elements comprise a plurality of pull-down resistors populated between a low side logic input of the gate driver and an electrical ground.

13. The washing machine of claim 10, wherein the motor control circuit further comprises an inverter electrically coupled to the motor, wherein the gate driver drives the motor by switching a plurality of switching elements included in the inverter, and wherein the one or more condition elements condition the one or more inputs of the gate driver to ensure that the gate driver activates selected ones of the plurality of switching elements included in the inverter when the gate driver is initialized.

14. A washing machine comprising:

a basket;

a motor which includes a rotor, the motor being configured to rotate the basket by rotating the rotor;

a user interface; and a motor control circuit configured to drive the motor, wherein the motor control circuit comprises:

a DC bus that is charged when the rotor is rotated;

a gate driver that applies passive braking to the rotor upon initialization; and an AC line sensor that senses the presence of externally supplied AC power;

wherein the motor control circuit is further configured to receive power generated by rotation of the rotor, monitor for the presence of a safety condition, and disable passive braking of the rotor when the safety condition is present; and wherein the user interface receives power from the DC bus after passive braking of the rotor is disabled.

15. The washing machine of claim 14, wherein the motor control circuit further comprises a processor that disables the gate driver when the DC bus is charged and the AC line sensor senses that externally supplied AC power is not present.

16. A washing machine, comprising:

a basket;

a motor that includes a rotor, wherein the motor rotates the basket by rotating the rotor;

a user interface; and a motor control circuit that receives power generated by manual rotation of the rotor, the motor control circuit comprising:

a gate driver that drives the motor, wherein the gate driver applies passive braking to the motor by default upon initialization; and a processor that monitors for the presence of a safety condition and, when the safety condition is present, disables the default passive braking of the rotor by the gate driver.

17. The washing machine of claim 16, wherein the motor control circuit further comprises:

one or more conditioning elements which condition one or more inputs of the gate driver to ensure that the gate driver applies passive braking to the motor by default upon initialization.

18. The washing machine of claim 17, wherein the one or more conditioning elements comprise a plurality of pull-down resistors populated between a low side logic input of the gate driver and an electrical ground.

19. The washing machine of claim 16, wherein the safety condition requires one or more of an absence of externally supplied AC power, a door of the washing machine in an open configuration, and a rotor speed less than a threshold speed.

* * * * *